US009470468B2

(12) United States Patent
McGinty

(10) Patent No.: US 9,470,468 B2
(45) Date of Patent: Oct. 18, 2016

(54) HANDGUARD WITH INTEGRATED POD AND FIREARM

(71) Applicant: FALKOR SID, INC., Kalispell, MT (US)

(72) Inventor: Aaron A. McGinty, Kalispell, MT (US)

(73) Assignee: FALKOR SID, INC., Kalispell, MT (US)

( * ) Notice: Subject to any disclaimer, the term of this patent is extended or adjusted under 35 U.S.C. 154(b) by 0 days.

(21) Appl. No.: 14/625,183

(22) Filed: Feb. 18, 2015

(65) Prior Publication Data

US 2015/0241160 A1 Aug. 27, 2015

Related U.S. Application Data

(60) Provisional application No. 61/943,860, filed on Feb. 24, 2014.

(51) Int. Cl.
*F41A 23/06* (2006.01)
*F41A 23/10* (2006.01)
*F41C 23/16* (2006.01)
(Continued)

(52) U.S. Cl.
CPC ..... *F41A 23/10* (2013.01); *F41A 23/04* (2013.01); *F41A 23/06* (2013.01); *F41A 23/08* (2013.01); *F41C 23/16* (2013.01)

(58) Field of Classification Search
CPC ..... F41A 23/12; F41A 23/06; F41A 23/10; F41A 23/14; F41C 23/16
USPC ..... 42/94, 72; 89/1.42
See application file for complete search history.

(56) References Cited

U.S. PATENT DOCUMENTS 3,144,808 A * 8/1964 Stapp ..... F41A 1/08 89/1.705
4,345,398 A * 8/1982 Pickett ..... F41A 23/06 42/94

(Continued)

FOREIGN PATENT DOCUMENTS

WO WO 2012009427 A2 * 1/2012 ..... F41A 23/04
WO WO 2012009427 A3 * 5/2012 ..... F41A 23/04

OTHER PUBLICATIONS

U.S. Appl. No. 61/920,008, filed Dec. 23, 2013, titled "Quick-Release Barrel Firearm", Inventor: Aaron A. McGinty.

(Continued)

*Primary Examiner* — Michael David
(74) *Attorney, Agent, or Firm* — Bennet K. Langlotz; Langlotz Patent & Trademark Works, Inc.

(57) ABSTRACT

Firearms and handguards for firearms having three pivotably attached pods wherein a first pod is deployable as a monopod and second and third pods are deployable together as a bipod, or having at least one pivotable pod having at least one hinge pin, at least one locking pin, and at least one return spring that biases the at least one locking pin. In some embodiments, a return spring, a slide spindle, a locking spindle, or a combination thereof, push two locking pins, for example, into opposite detents when the pod is pivoted into a deployed position, and the pod can be released by moving a slide button and secured in a stowed position with a catch. In certain embodiments, the monopod is pivotably attached to the handguard aft of where the bipod is pivotably attached to the handguard. In particular embodiments, the firearm is an AR-15 or an M-16.

10 Claims, 5 Drawing Sheets

HANDGUARD WITH INTIGRATED MONOPOD STOWED AN INTEGRATED BIPOD DEPLOYED

(51) Int. Cl.
*F41A 23/04* (2006.01)
*F41A 23/08* (2006.01)

(56) References Cited

U.S. PATENT DOCUMENTS 4,393,614 A * 7/1983 Pickett ..... F41A 23/06 42/94
4,625,620 A * 12/1986 Harris ..... F41A 23/08 42/94
4,676,021 A * 6/1987 Groba ..... F16B 2/246 42/94
4,776,124 A * 10/1988 Clifton ..... F41A 23/08 42/94
5,029,407 A * 7/1991 Kirkpatrick ..... F41A 23/10 42/94
5,074,188 A * 12/1991 Harris ..... F41A 23/08 42/94
5,711,103 A * 1/1998 Keng ..... F41A 23/10 42/94
6,289,622 B1 * 9/2001 Desch, Jr. ..... F41A 23/10 42/94
6,305,116 B1 * 10/2001 Parker ..... F41A 23/04 42/94
6,609,321 B2 * 8/2003 Faifer ..... F41G 11/003 42/124
7,100,318 B1 * 9/2006 Beltz ..... F41A 23/06 248/274.1
7,428,794 B2 * 9/2008 Oz ..... F41A 23/02 42/73
7,614,174 B1 * 11/2009 Beltz ..... F41A 23/10 42/72
7,676,977 B1 * 3/2010 Cahill ..... F16M 11/16 248/168
7,779,572 B2 * 8/2010 Potterfield ..... F41A 23/10 42/94
7,856,748 B1 * 12/2010 Mertz ..... F41A 23/08 42/71.01
7,954,272 B2 * 6/2011 Potterfield ..... F41A 23/10 248/125.8
8,156,676 B1 * 4/2012 Moody ..... F41A 23/06 42/71.01
8,307,750 B2 11/2012 Vuksanovich et al.
8,458,946 B1 * 6/2013 Pintsch ..... F41A 23/08 42/90
8,549,786 B1 * 10/2013 Griffith ..... F41A 23/14 42/94
8,769,854 B1 * 7/2014 Battaglia ..... F41A 3/66 42/71.01
8,869,442 B2 10/2014 Moody et al.
8,893,608 B2 11/2014 Kramer
8,899,138 B2 12/2014 Brown
8,910,406 B1 12/2014 Huang et al.
9,052,156 B2 * 6/2015 Nevils ..... F41C 33/001
9,091,505 B1 * 7/2015 Battaglia ..... F41C 23/20
9,121,665 B2 * 9/2015 Hinds ..... F41A 23/04
9,239,210 B2 * 1/2016 Mayberry ..... F41C 23/16
2002/0074467 A1 * 6/2002 Harris ..... F16M 11/36 248/188.9
2003/0074822 A1 * 4/2003 Faifer ..... F41C 23/16 42/71.01
2007/0011932 A1 * 1/2007 Oz ..... F41A 23/06 42/94
2008/0295379 A1 * 12/2008 Potterfield ..... F41A 23/10 42/94
2008/0307689 A1 * 12/2008 Dotson ..... F41A 23/06 42/94
2009/0056192 A1 * 3/2009 Oz ..... F41C 23/16 42/94
2009/0064559 A1 * 3/2009 Potterfield ..... F41G 11/004 42/94
2009/0126250 A1 * 5/2009 Keng ..... F41A 23/10 42/94
2010/0102178 A1 * 4/2010 Smith ..... F16M 11/04 248/122.1
2013/0174463 A1 * 7/2013 Hinds ..... F41A 23/04 42/94
2014/0082985 A1 * 3/2014 Larue ..... F41G 11/003 42/90
2014/0130390 A1 * 5/2014 Geissele ..... F41C 23/16 42/71.01
2014/0215888 A1 * 8/2014 Barber ..... F41A 23/14 42/94
2014/0259849 A1 * 9/2014 Jakele ..... F41C 23/20 42/74
2014/0290108 A1 * 10/2014 Nevils ..... F41C 33/001 42/1.06
2014/0305019 A1 * 10/2014 King, Jr. ..... F41C 23/18 42/71.01
2014/0361143 A1 * 12/2014 May ..... F41B 5/1453 248/688
2015/0241160 A1 * 8/2015 McGinty ..... F41C 23/16 42/94
2015/0285583 A1 * 10/2015 Mayberry ..... F41G 11/005 42/71.01
2015/0285584 A1 * 10/2015 Mayberry ..... F41C 23/16 42/71.01
2016/0040948 A1 * 2/2016 Barrett ..... F41A 3/66 89/136
2016/0091277 A1 * 3/2016 Mayberry ..... F41C 23/16 42/71.01

OTHER PUBLICATIONS

U.S. Appl. No. 14/579,797, filed Dec. 22, 2014, titled "Quick-ReleaseFirearm", Inventor: Aaron A. McGinty.
U.S. Appl. No. 61/920,026, filed Dec. 23, 2013, titled "Internal Latch in Charging Handle of Firearm", Inventor: Aaron A. McGinty.
U.S. Appl. No. 14/579,893, filed Dec. 22, 2014, titled "Internal Latch in Charging Handle of Firearm", Inventor: Aaron A. McGinty.
U.S. Appl. No. 61/920,164, filed Dec. 23, 2013, titled "Intermediate Charging Handle Engagement With Carrier of Firearm", Inventor: Aaron A. McGinty.
U.S. Appl. No. 14/581,694, filed Dec. 23, 2014, titled "Intermediate Charging Handle Engagement With Carrier of Firearm", Inventor: Aaron A. McGinty.
U.S. Appl. No. 61/920,213, filed Dec. 23, 2013, titled "Firearm Capable of Ejecting Shell Casing on Either Side", Inventor: Aaron A. McGinty.
U.S. Appl. No. 14/581,755, filed Dec. 23, 2014, titled "Dual Injection Port Firearm", Inventor: Aaron A. McGinty.
U.S. Appl. No. 61/920,234, filed Dec. 23, 2013, titled "Cross Ventilation Through Ejection Ports of Firearm", Inventor: Aaron A. McGinty.
U.S. Appl. No. 61/925,768, filed Jan. 10, 2014, titled "Ambidextrous Bolt Catch of Firearm", Inventor: Aaron A. McGinty.
U.S. Appl. No. 14/594,924, filed Jan. 12, 2015, titled "Ambidextrous Bolt Catch and Magazine Release and Firearm", Inventor: Aaron A. McGinty.
U.S. Appl. No. 61/932,874, filed Jan. 29, 2014, titled "Bolt Buffer and Firearm", Inventor: Aaron A. McGinty.
U.S. Appl. No. 14/608,894, filed Feb. 10, 2015, titled "Bolt Buffer and Firearm", Inventor: Aaron A. McGinty.
U.S. Appl. No. 61/936,022, filed Feb. 5, 2014, titled "Carrier Guide and Firearm", Inventor: Aaron A. McGinty.
U.S. Appl. No. 14/593,116, filed Jan. 9, 2015, titled "Carrier Guide and Firearm", Inventor: Aaron A. McGinty.
U.S. Appl. No. 61/949,907, filed Mar. 7, 2014, titled "Charging Handle Engagement With Carrier Key of Firearm", Inventor: Aaron A. McGinty.
U.S. Appl. No. 14/632,706, filed Feb. 26, 2015, titled "Charging Handle Engagement With Carrier Key of Firearm", Inventor: Aaron A. McGinty.
U.S. Appl. No. 61/974,322, filed Apr. 2, 2014, titled "Ambidextrous Magazine Release and Firearm", Inventor: Aaron A. McGinty.

* cited by examiner

HANDGUARD WTH INTIGATED MONOPOD
STOWED AND INTIGRADED BIPOD STOWED

SECTION A-A
MONOPOD AND BIPOD ARE
SHOWN STOWED IN THIS VIEW

HANDGUARD WITH INTIGRATED MONOPODE
DEPLOYED AND INTEGRADED BIPOD STOWED

SECTION B-B
THE MONOPOD IS SHOWN DEPLOYED IN THIS VIEW AND THE BIPOD IS STOWED IN THIS VIEW

SECTION C-C
THE MONOPOD IS SHOWN DEPLOYED IN THIS VIEW AND THE BIPOD IS STOWED IN THIS VIEW

HANDGUARD WITH INTIGRATED MONOPOD STOWED AN INTEGRATED BIPOD DEPLOYED

HANDGUARD WITH INTEGRATED POD AND FIREARM

RELATED PATENT APPLICATIONS

This patent application claims priority to U.S. Provisional Patent Application No. 61/943,860, filed on Feb. 24, 2014, titled HANDGUARD WITH INTEGRATED POD AND FIREARM, which has at least one inventor in common with the current patent application and the same assignee. The contents of this priority provisional patent application are incorporated herein by reference.

FIELD OF THE INVENTION

Various embodiments of this invention relate to firearms. Particular embodiments relate to handguards, monopods, and bipods for firearms, firearms having such features, and methods concerning such features and firearms.

BACKGROUND OF THE INVENTION

Firearms have been used for several centuries for various purposes including as weapons for warfare, law enforcement, self defense, hunting, and target practice. Although many new weapons and weapon systems have been developed, firearms are still widely used and soldiers are trained in firearm use and carry firearms in essentially all armies throughout the world. Over time, firearms have been improved in many ways, but opportunities for improvement still exist in particular areas and for particular aspects of these devices.

In addition, Firearms have been used with a bipod or monopod that supports the firearm, steadies the firearm for more accurate shooting, or both. Furthermore, various firearms have been equipped with a hand guard or handguard that covers or surrounds all or part of the barrel of the firearm to protect the operator's hand from heat from the barrel when the firearm has been fired many times in a short period of time. Moreover, handguards have also provided a larger surface to hold the firearm when being fired and at other times. Additionally, bipods and monopods have been attached to the barrel or handguard of a firearm.

In a number of prior art firearms, monopods or bipods have been desired at certain times but not needed at other times, and have been found to get in the way when attached to the firearm when not needed. Further, in a number of prior art firearms, monopods have been desired in certain situations, while bipods have been desired in other situations, and it has been difficult or time consuming to change between use of a monopod, a bipod, or no pods at all. Even further, needs or potential for benefit or improvement exist for firearms wherein monopods or bipods (or both) are readily available when needed, but are readily moved out of the way when not needed. Still further, needs or potential for benefit or improvement exist for firearms and handguards that can be fitted with one or more pods (e.g., a monopod or bipod) more easily, where pods can be taken out of the way more easily, that are easier to use generally, that provide more features or options for use, that are lighter in weight, that offer a more-desirable weight distribution, that are less fatiguing to use, that provide for a steadier shot, that last longer, that are more compact, that provide a superior grip for the operator's hand, that deploy or stow more easily, that remain in a deployed position better, or a combination thereof, as examples. Room for improvement exists over the prior art in these and other areas that may be apparent to a person of skill in the art having studied this document.

SUMMARY OF PARTICULAR EMBODIMENTS OF THE INVENTION

This invention provides, among other things, firearms with improved systems and methods of handguards, monopods, bipods, or a combination thereof. In a number of embodiments, monopods or bipods (or both) are available to the operator when needed or desired but can easily be moved out of the way and stowed when not desired or not needed at other times. In addition, in various embodiments, pods are kept out of the way when not needed. Further, in a number of firearms, monopods are available when desired in certain situations, and bipods are available when desired in other situations. Moreover, in particular embodiments, it is not difficult or time consuming to change between use of a monopod, a bipod, or no pods at all, for example.

Even further, a number of embodiments are easier to use generally, provide more features or options for use, are lighter in weight, offer a more-desirable weight distribution, are less fatiguing to use, provide for a steadier shot, last longer, are more compact, provide a superior grip for the operator's hand, or a combination thereof, as examples, in comparison with certain prior art alternatives. Further still, certain embodiments provide improved pivotable pods and mechanisms to hold pods, for example, in a deployed position.

Various embodiments, in addition to firearms, include handguards, pod systems, and a number of methods, for example, of configuring, obtaining, or providing a firearm having certain components or structure described herein. In a number of embodiments, improvements to firearms herein provide for firearms that are more reliable, that last longer, that are more adaptable, that can be used in conditions that are more extreme, that handle abuse well, that work better, that are easier to use, that are easier to maintain, that are less expensive to manufacture, that have a lower lifecycle cost, that offer more options for use, that can be fired more easily, more accurately, or both, for instance, for a longer period of time, that remain in a deployed position better, that are easier to deploy or stow, or a combination thereof, in comparison with certain alternatives.

Specific embodiments include various firearms that each include, for example, three pivotably attached pods. In a number of embodiments, a first pod of the three pivotably attached pods is deployable as a monopod, for example. Further, in various embodiments, a second pod of the three pivotably attached pods and a third pod of the three pivotably attached pods are deployable together as a bipod, for instance. Further still, in a number of such embodiments, each of the three pivotably attached pods includes at least one hinge pin, at least one locking pin, at least one return spring, or a combination thereof. Even further, in some such embodiments, the return spring biases at least one locking pin. Moreover, in some of these embodiments, the firearm includes a handguard, and the first pod, the second pod, the third pod, or a combination thereof, are (e.g., each) pivotably attached to the handguard, for example.

Furthermore, in particular of these embodiments, each of the three pivotably attached pods include a return spring, a slide spindle, a locking spindle, a slide button, for example, attached to the slide spindle, a first locking pin, a second locking pin, or a combination thereof (e.g., all thereof). Even further still, in some such embodiments, for each of the three pivotably attached pods, the firearm includes two opposite detents, and for each of the three pivotably attached pods, the return spring biases the slide spindle against the locking spindle, the locking spindle pushes the first locking pin and the second locking pin in opposite directions into the two opposite detents, or both, for example.

Other specific embodiments include, as other examples, a firearm that includes at least one pivotable pod wherein at least one pivotable pod includes at least one hinge pin, at least one locking pin, and at least one return spring, for example, that biases at least one locking pin. Further, in some such embodiments, each pivotable pod further includes an adjustable threaded foot, for instance, that provides length adjustment of the pod.

Still other specific embodiments include various handguards for a firearm, for instance, each handguard including at least one pivotable pod that includes at least one hinge pin, at least one locking pin, and at least one return spring, for example, that biases at least one locking pin. Further, in some such embodiments, at least one pivotable pod includes at least one slide spindle, and in particular embodiments, at least one return spring biases at least one slide spindle. Still further, in some embodiments, at least one pivotable pod includes at least one locking spindle, and in certain embodiments, at least one locking spindle biases at least one locking pin.

Even further, in some embodiments, at least one return spring biases at least one slide spindle against at least one locking spindle. Further still, some embodiments include at least one slide button, for example, attached to at least one slide spindle. Even further still, in some embodiments, at least one locking pin includes a first locking pin and a second locking pin. Furthermore, in some embodiments, the locking spindle pushes the first locking pin and the second locking pin, for instance, in opposite directions, for example, into two opposite (e.g., hemispherical) detents. In a number of embodiments, this occurs, for instance, when at least one pivotable pod is pivoted, for example, into a deployed position. Moreover, in some embodiments, at least one hinge pin includes a first hinge pin and a second hinge pin.

In certain embodiments, the pods, or at least one pivotable pod, is telescopically extendable. Further, particular embodiments further include at least one catch for at least one pivotable pod that secures at least one pivotable pod within the handguard when at least one pivotable pod is stowed. Even further, in some embodiments, at least one pivotable pod includes a first pod deployable as a monopod, a second pod and a third pod deployable together as a bipod, or all three such pods, as examples. Still further, in some embodiments, the first pod is pivotably attached to the handguard, the second pod is pivotably attached to the handguard, and the third pod is pivotably attached to the handguard. Even further still, in some embodiments, the first pod, the second pod, and the third pod each have a common length. Moreover, in some embodiments, the handguard includes a forward end and an aft end and the first pod, the second pod, and the third pod are all pivotably attached to the handguard at the forward end.

Further, in particular embodiments, each of the first pod, the second pod, and the third pod includes a return spring, a slide spindle, a locking spindle, a slide button attached to the slide spindle, a first locking pin, a second locking pin, or a combination thereof. Moreover, certain embodiments include a first hinge pin, a second hinge pin, or both. Further still, in some embodiments, for each of the first pod, the second pod, and the third pod, for example, the handguard includes two (e.g., opposite) detents. Even further, in a number of such embodiments, the return spring biases the slide spindle, for instance, against the locking spindle. Still further, in various embodiments, the locking spindle pushes the first locking pin, the second locking pin, or both, for example, in opposite directions, for instance, into the two (e.g., opposite) detents in the handguard. In some embodiments, for example, the locking pins move into the detents when the first pod, the second pod, or the third pod, as examples, is pivoted, for instance, into a deployed position. In addition, various other embodiments of the invention are also described herein, and other benefits of certain embodiments may be apparent to a person of skill in this area of technology.

BRIEF DESCRIPTION OF THE DRAWINGS

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples. Reference numbers on the drawings identify different parts, assemblies, aspects, or regions described in the detailed description section of this document, and the same reference number often identifies the same part, assembly, aspect, or region in different views. In most or all instances, the left one or two digits of each reference number (e.g., all digits except for the right digit) correspond to a figure number in which that part, assembly, aspect, or region is fairly-well illustrated, but other views may show other details.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments are or concern firearms, for example, having improvements over the prior art. Different embodiments include firearms, mechanisms for firearms, handguards for firearms, pod systems for firearms, and methods that provide for monopods, bipods, or both, for example, stored within firearms, for instance, within the handguard of the firearm. In a number of embodiments, the firearm is an AR-15 or an M-16, for example. Further, in many embodiments, the handguard or hand guard surrounds the barrel of the firearm, for instance, just forward of the upper receiver. In a number of embodiments, the handguard has a two-piece body that clamps to the upper receiver, for example, with fasteners, such as screws.

Figure 1:
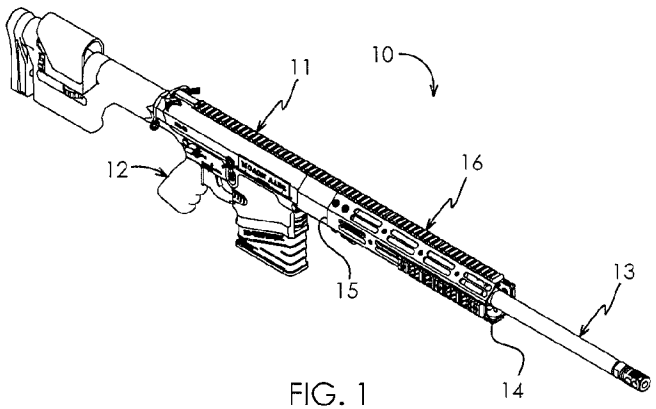
FIG. 1 is an isometric view of an example of an embodiment of a firearm having a handguard illustrated with all pods in a stowed position.
Figure 4:
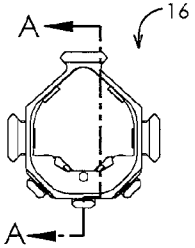
FIG. 4 is a front view of the handguard of the firearm of FIG. 1 shown with all pods stowed.
Figure 2:
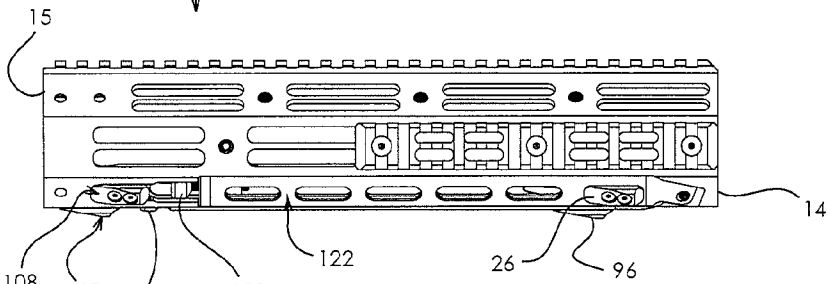
FIG. 2 is a right side view of the handguard of the firearm of FIG. 1 shown with all pods stowed.

FIG. 1 illustrates an example of a firearm, firearm 10, that includes upper receiver 11, lower receiver 12, barrel 13, and handguard 16, among other things. In various embodiments, a firearm (e.g., 10) or a handguard (e.g., 16) includes three pivotably attached legs or pods (e.g., 61, 122, and 123 shown in FIGS. 6-13), which can be slender or elongated, for example. As used herein, a member is considered to be slender if it has a length dimension (e.g., 90, shown in FIG. 9 for pod 61) that is at least five times longer than any major dimension that is perpendicular to the length dimension. Further, as used herein, a member is considered to be elongated if it has a length dimension (e.g., 90 for pod 61) that is at least ten times longer than any major dimension that is perpendicular to the length dimension.

Figure 8:
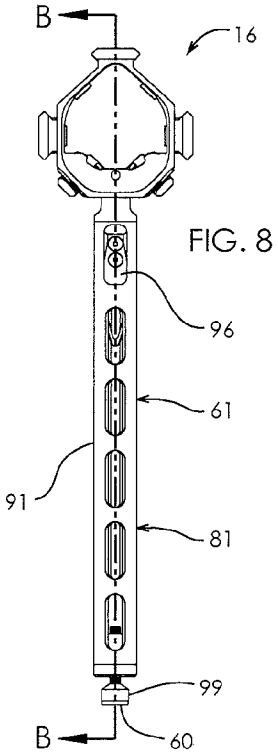
FIG. 8 is a front view of the handguard of the firearm of FIG. 1 with the monopod deployed and the bipod stowed.
Figure 6:
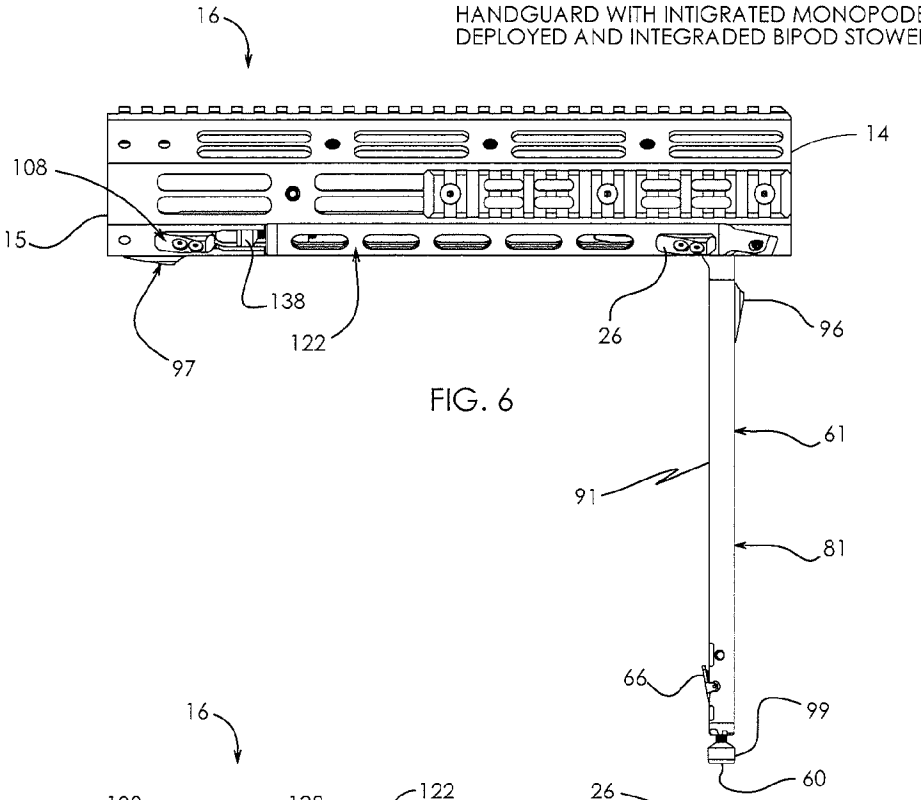
FIG. 6 is a right side view of the handguard of the firearm of FIG. 1 shown with the monopod deployed and the bipod stowed.
Figure 7:
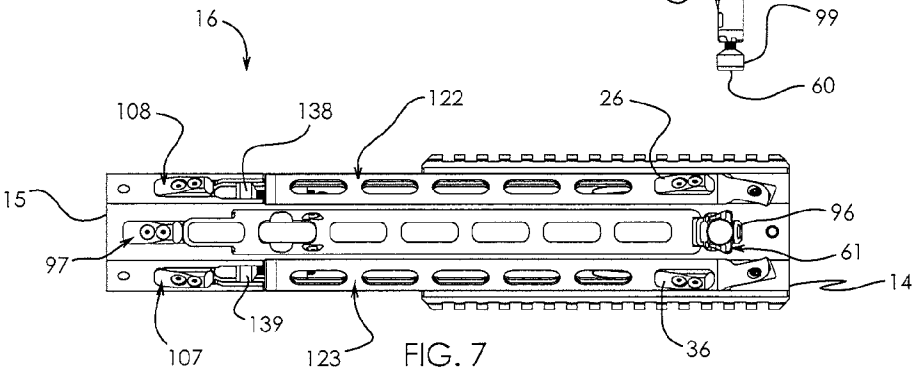
FIG. 7 is a bottom view of the handguard of the firearm of FIG. 1 with the monopod deployed and the bipod in the stowed position.
Figure 9:
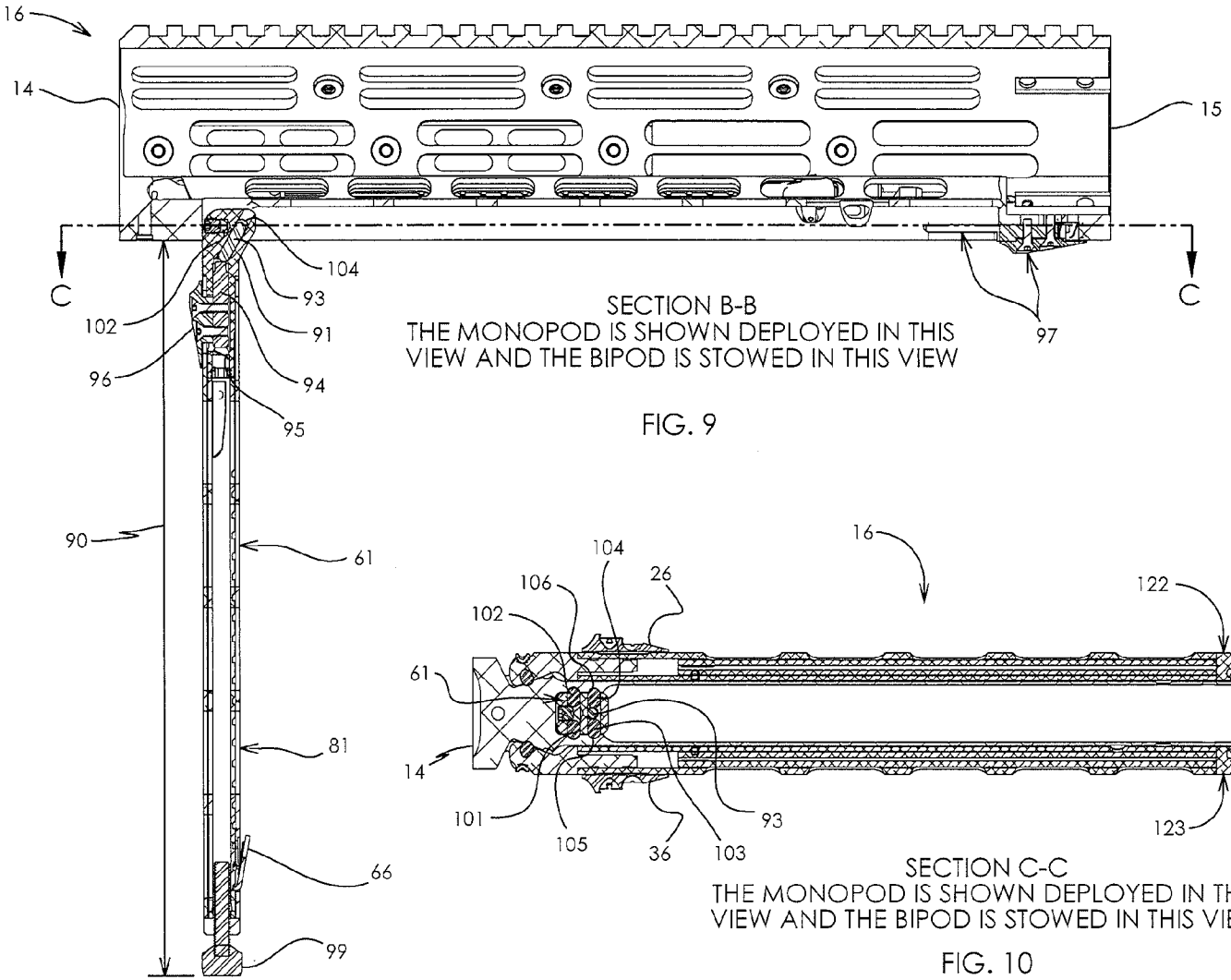
FIG. 9 is a left side cross-sectional view of part of the handguard of the firearm of FIG. 1 taken along section B-B in FIG. 8, with the monopod deployed and the bipod stowed.
Figure 13:
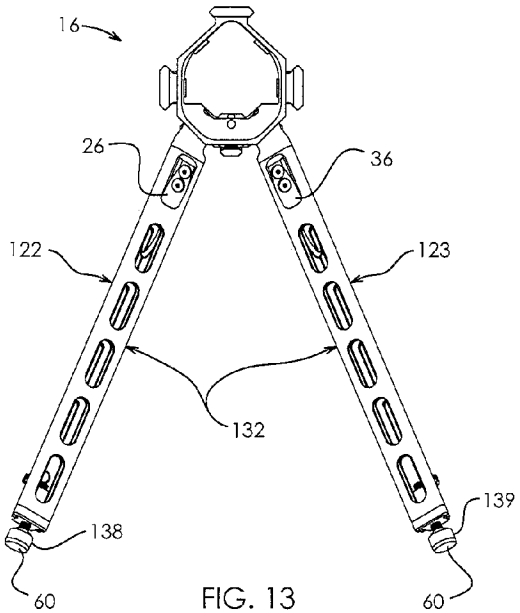
FIG. 13 is a front view of the handguard of the firearm of FIG. 1 illustrated with the monopod stowed and the bipod deployed.
Figure 11:
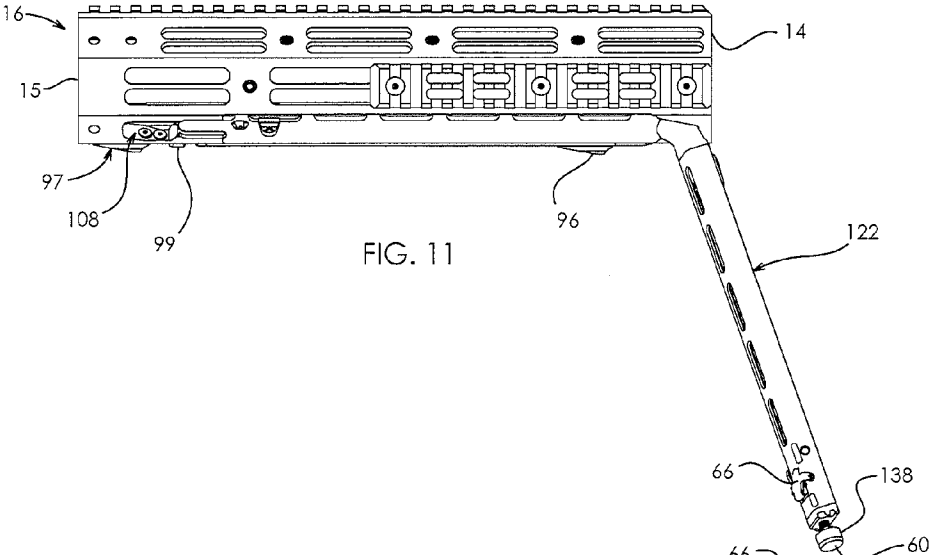
FIG. 11 is a right side view of the handguard of the firearm of FIG. 1 shown with the monopod stowed and the bipod deployed.
Figure 12:
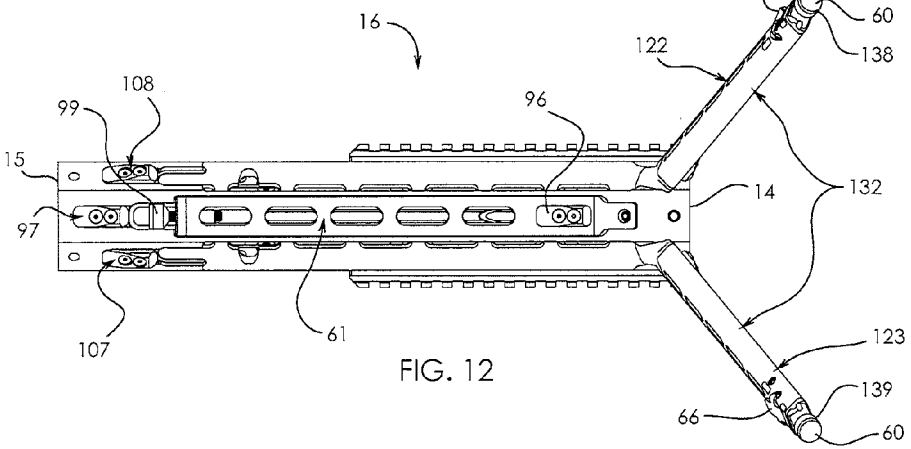
FIG. 12 is a bottom view of the handguard of the firearm of FIG. 1 with the monopod stowed and the bipod in the deployed position.

In some embodiments, for example, a first pod (e.g., 61) of the pivotably attached pods (e.g., 61, 122, and 123) is deployable as a monopod (e.g., 81, for instance, as shown in FIGS. 6, 8, and 9) and a second pod (e.g., 122) of the pivotably attached pods and a third pod (e.g., 123) of the pivotably attached pods are deployable together (i.e., the second and third pods 122 and 123 are both deployed) as a bipod (e.g., 132 shown in FIGS. 11-13). As used herein, a pod is "deployable" if the pod can be repeatedly extended from a stowed position by the operator of the firearm to a deployed position without using tools. Further, as used herein, a pod being "pivotably attached" to a firearm or to a handguard means that the pod can be repeatedly pivoted from a stowed position to a deployed position and back by an operator of the firearm without disconnecting the pod from the firearm or handguard. Further, two pods (e.g., 122 and 123) being deployable "together" does not require that the two pods both deploy at the same instant or in the same motion, but rather, requires that they both be in a deployed position (e.g., achieving that position in either order or at the same time), for instance, when used as a bipod (e.g., 132).

Figure 3:
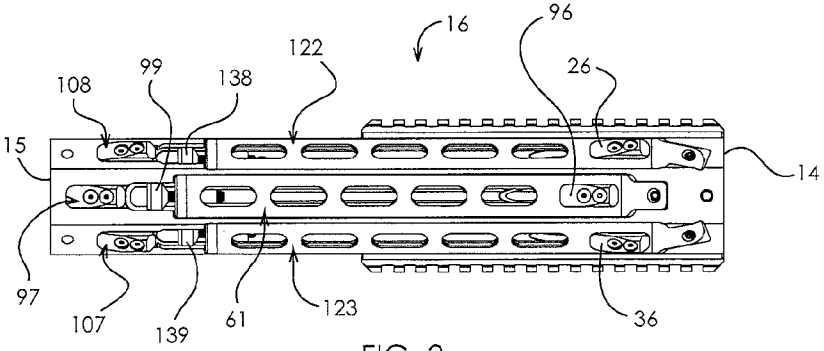
FIG. 3 is a bottom view of the handguard of the firearm of FIG. 1 shown with all pods in the stowed position.

In a number of embodiments, the first pod (e.g., 61) is located between the second pod (e.g., 122) and the third pod (e.g., 123), for example, when the pods (e.g., 61, 122, and 123) are stowed (e.g., as shown in FIG. 3). In certain embodiments, for instance, the firearm (e.g., 10) includes a handguard (e.g., 16), and the first pod (e.g., 61), the second pod (e.g., 122), and the third pod (e.g., 123) are each pivotably attached (e.g., with one or two hinge pins, for instance, 101 and 102 shown in FIG. 10 for first pod 61) to the handguard (e.g., 16). Further, in some embodiments, the first pod (e.g., 61) is stowed at and attached to the center of the bottom of the handguard (e.g., handguard 16, for instance, as shown in FIG. 8), and the second and third pods (e.g., 122 and 123) are stowed at and attached to the handguard (e.g., 16) on either side of the first pod (e.g., 61), for instance, on the right side and the left side of the bottom of the handguard (e.g., as shown in FIG. 13).

Other embodiments are specifically handguards (e.g., 16) for firearms (e.g., 10), and the handguard (e.g., 16), in a number of embodiments, includes the three pivotably attached pods, for example, the first pod (e.g., 61) being deployable as a monopod (e.g., 81) and the second pod (e.g., 122) and the third pod (e.g., 123) being deployable together as a bipod (e.g., 132). As used herein, a monopod is a leg or pod that is substantially vertical when deployed when the firearm is in a normal orientation for firing (e.g., as shown in FIG. 8) substantially horizontally (e.g., as shown in FIGS. 6 and 9). As used herein, a monopod is capable of supporting the entire weight of the firearm but the operator of the firearm may typically need to balance the firearm on the monopod and may typically support the aft end of the firearm when aiming and firing the weapon at a target.

Further, as used herein, a bipod is a support structure consisting of two legs or pods that are each at a substantially equal angle from vertical when deployed when the firearm is in a normal orientation for firing (e.g., as shown in FIG. 13) substantially horizontally (e.g., as shown in FIG. 11). As used herein, a bipod is capable of supporting the entire weight of the firearm and the operator of the firearm does not typically need to balance the firearm on the bipod but may typically support the aft end of the firearm when aiming or firing the weapon at a target. Still further, as used herein, "substantially", when referring to an angle, means within 15 degrees. In various embodiments, the pods (e.g., 122 and 123) that make up a bipod (e.g., 132) may each be at an (e.g., equal but opposite) angle (e.g., as seen from the front of the weapon, for example, as shown in FIG. 13) between 15 and 60 degrees from vertical, between 20 and 45 degrees from vertical, between 25 and 40 degrees from vertical, or about 30 degrees from vertical, as examples, when the firearm (e.g., 10) is in a normal orientation for firing substantially horizontally and is supported by the bipod (e.g., 132) on a horizontal surface.

In different embodiments, the second and third pods (e.g., 122 and 123) can be moved into the deployed position one at a time or at the same time, as examples, and being deployable "together", as used herein, does not necessarily require that the second and third pods (e.g., 122 and 123) are connected, although in some embodiments the second and third pods are connected, for instance, where they pivot. In other embodiments, the second and third pods (e.g., 122 and 123) are independent of each other (e.g., as shown) and move independently of each other, although they would generally be used together (e.g., at the same time) to support the firearm (e.g., 10) when firing the weapon.

In some embodiments, each of the three pivotably attached pods (e.g., 61, 122, and 123) has or includes at least one hinge pin (e.g., 101 and 102 shown in FIG. 10), for example, about which the pod pivots, for instance, when the pod is moved by the operator into a deployed or stowed position. In a number of embodiments, the hinge pin is where the pod (e.g., 61, 122, or 123) attaches to the handguard (e.g., 16) or remainder of the firearm (e.g., 10). Further, in a number of embodiments, each of the three pivotably attached pods (e.g., 61, 122, and 123) includes at least one locking pin (e.g., 103 and 104 shown in FIG. 10), for example, that holds the pod (e.g., 61) in a deployed position (e.g., deployed positions being shown in FIGS. 6-13 for the different pods). As used herein, a "locking pin" is a pin that holds the pod (e.g., pod 61 for locking pins 103 and 104) in a particular position (e.g., the deployed position) when the pod is placed in that position by the operator.

In a number of embodiments, the same or different locking pins also hold the pod in a stowed position, but in other embodiments, a different mechanism (e.g., catch 97 shown in FIGS. 2-7 and 9-12 in the embodiment illustrated for pod 61) provides that function. Even further, in some embodiments of a firearm (e.g., 10) or handguard (e.g., 16), as examples, each of the pods (e.g., 61, 122, and 123) includes at least one locking mechanism return spring (e.g., 95 shown in FIG. 9 for pod 61). In a number of embodiments, the return spring (e.g., 95) biases (e.g., pushes) the at least one locking pin (e.g., 103 and 104), for example, into a locked position, for instance, holding the pod (e.g., 61) in the deployed position. As used herein, "bias" of "biases" means apply or applies a force against (e.g., push, pull, or twist), but does not necessarily require direct contact, although where the word "bias" or "biases" is used herein, direct contact is an example of an embodiment unless indicated otherwise or not feasible.

In a number of embodiments, the locking mechanism return spring (e.g., 95) pushes on the slide spindle (e.g., 94), which pushes on the locking spindle (e.g., 93), which pushes the locking pin or pins (e.g., 103 and 104) into a detent or detents (e.g., 105 and 106 shown in FIG. 10) to hold the pod (e.g., 61) in the deployed position (e.g., the deployed position shown in FIGS. 6, 8, and 9 for first pod 61 or monopod 81). In a number of embodiments, these pushing forces (e.g., originating from return spring 95) are maintained until the operator slides the locking mechanism slide button (e.g., 96 shown in FIGS. 2, 3, 5-9, 11, and 12) to release the pressure or force (e.g., to release locking pins 103 and 104).

Figure 10:
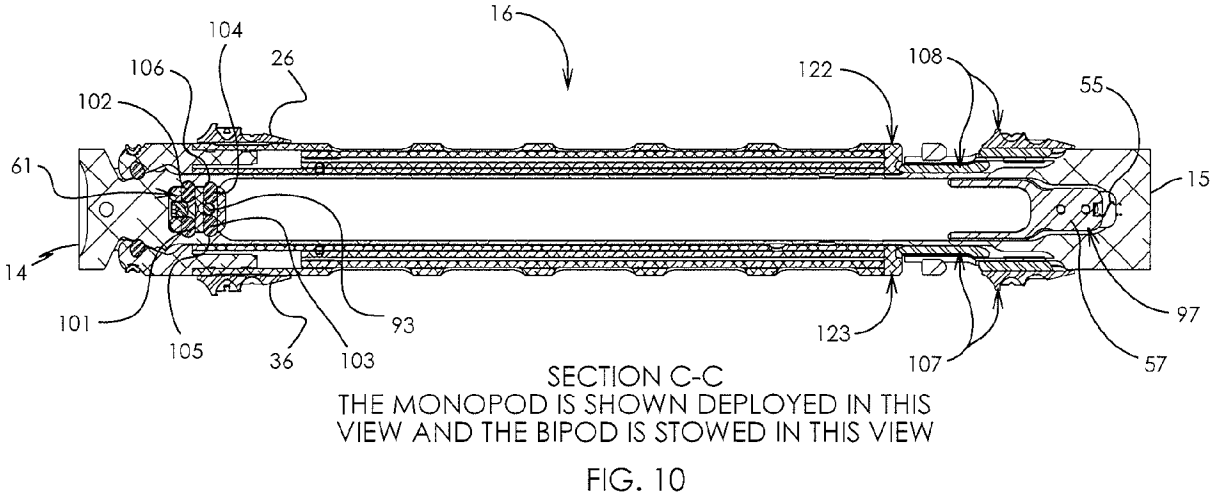
FIG. 10 is a top cross-sectional view of part of the handguard of the firearm of FIG. 1 taken along section C-C in FIG. 9, with the monopod deployed and the bipod stowed.

Other embodiments do not necessarily have three pods (e.g., 61, 122, and 123). For instance, some embodiments include a bipod but not a monopod or a monopod but not a bipod, while other embodiments (e.g., firearm 10 and handguard 16) include both a bipod (e.g., 132) and a monopod (e.g., 81). Still other embodiments include two bipods or a tripod, as other examples. In a number of embodiments, for example, a firearm (e.g., 10) or a handguard (e.g., 16) includes at least one pivotable pod (e.g., 61, 122, 123, or a combination thereof) and the at least one pivotable pod includes at least one hinge pin (e.g., 101, 102, or both), at least one locking pin (e.g., 103, 104, or both), and at least one return spring (e.g., 95), for example, that biases the at least one locking pin (e.g., 103 and 104), for instance, into a locked position (e.g., as shown in FIG. 10). In various embodiments, the return spring (e.g., 95) is located inside the pod (e.g., 61), the return spring (e.g., 95) is a helical spring, the return spring (e.g., 95) is metal, such as steel or stainless steel, the return spring (e.g., 95) has an axis (e.g., of the helix of the spring) that is parallel with or concentric with the axis of the pod (e.g., 61), the return spring (e.g., 95) is loaded in compression, or a combination thereof, as examples. As used herein, "parallel" means to within 10 degrees, and "concentric with", when referring to a pod, means within 20 percent of a diameter or other lateral dimension of the pod (e.g., measured perpendicular to the axis of the barrel of the firearm (e.g., 10) when the pod is stowed with its axis parallel to the axis of the barrel.

In certain embodiments, the firearm (e.g., 10), handguard (e.g., 16), or pod (e.g., 61, although pods 122 and 123 may be similar) includes a slide spindle (e.g., 94 shown in FIG. 9), for example, that is slidable within the pod (e.g., 61). Further, in particular embodiments, the return spring (e.g., 95) biases (e.g., pushes) the slide spindle (e.g., 94). Moreover, in some embodiments, the firearm (e.g., 10) or handguard (e.g., 16), or the pod (e.g., 61), includes at least one locking pin (e.g., 103 and 104 shown in FIG. 10). In particular embodiments, for example, each pod (e.g., 61, 122, and 123) includes a locking spindle (e.g., 93 shown in FIG. 9 for pod 61), for example, that is slidable within the pod, and the locking spindle (e.g., 93) biases the (e.g., at least one) locking pin (e.g., 103 and 104 shown), for instance, pushing the locking pin or pins into one or more detents (e.g., 105 and 106 shown in FIG. 10), for example, in the handguard (e.g., 16) body. In various embodiments, engagement of the locking pin(s) (e.g., 103 and 104) with the detent(s) (e.g., 105 and 106) acts to retain the pod in a deployed position (e.g., as shown in FIGS. 6-10 for pod 61), for instance.

In different embodiments, the detents (e.g., 105 and 106) are hollow areas or cavities that are open to a surface (e.g., of handguard 16), for instance, that the locking pin or pins (e.g., 103 and 104) extend into to lock the pod (e.g., 61) in position (e.g., the deployed position shown in FIGS. 6, 8, and 9). In some embodiments, detents (e.g., 105 and 106) are hemispherical. In other embodiments, detents are cylindrical, as another example. In still other embodiments, detents are conical, as yet another example. In other embodiments, detents can be polygonal, triangular, square, rectangular, pentagonal, hexagonal, octagonal, oval, hyperbolic, elliptical, or trapezoidal, as examples, or a frustum or pyramid shape, as further examples.

Further, in some embodiments, the return spring (e.g., 95) biases the slide spindle (e.g., 94) against the locking spindle (e.g., 93). Further still, in some embodiments, a lock release slide button (e.g., 96 shown in FIGS. 2, 3, 5-9, 11, and 12), for example, external to the housing or body (e.g., 91) of the pod (e.g., 61) is attached to the slide spindle (e.g., 94), for example, with one or more fasteners or screws, for instance, with two screws (as shown, for instance, in FIG. 9). In certain embodiments, the screws that secure the slide button (e.g., 96) extend through an opening (e.g., a slot or oval-shaped opening) in a wall of the pod (e.g., 61), for example. In the embodiment illustrated, the operator pushes downward on slide button 96 to move (i.e., slide) slide button 96 downward, sliding slide spindle 94, to release locking spindle 93, which allows locking pins 103 and 104 to move out of hemispherical detents 105 and 106 to release pod 61 from the extended position (e.g., shown in FIGS. 6, 8, and 9) so the operator can fold pod 61 or monopod 81 back into handguard 16 to stow that pod. In a number of embodiments, pods 122 and 123 may each have a similar pod release mechanism with similar components (e.g., slide buttons 26 and 36 shown in FIGS. 2, 3, 6, 7, 10, and 13). As used herein, the word "similar", unless indicated otherwise, includes identical, for instance, within manufacturing tolerances.

Even further, in a number of embodiments, the at least one locking pin (e.g., 103 and 104) includes a first locking pin (e.g., 103) and a second locking pin (e.g., 104). In various embodiments, the first locking pin (e.g., 103) and the second locking pin (e.g., 104) are in line. As used herein, two pins are "in line" if the centerlines of the pins, over the length of the pins, are within the same straight line through space, to within the diameter of the pins. In certain embodiments, the locking spindle (e.g., 93) biases (e.g., pushes and holds) the first locking pin (e.g., 103) and the second locking pin (e.g., 104) in opposite directions, for example, into opposite (e.g., hemispherical) detents (e.g., 105 and 106), for instance, in the handguard (e.g., 16) body, for instance, when the pod (e.g., 61) is (e.g., fully) pivoted into a deployed position (e.g., as shown in FIGS. 6-10). Still further, in particular embodiments, the at least one hinge pin (e.g., 101 and 102) includes a first hinge pin (e.g., 101) and a second hinge pin (e.g., 102). Moreover, in some embodiments, the first hinge pin (e.g., 101) and the second hinge pin (e.g., 102) are in line. In various embodiments, the at least one hinge pin (e.g., 101 and 102) or the first hinge pin (e.g., 101) and the second hinge pin (e.g., 102) are located partially within the pod (e.g., 61) and partially within the body of the handguard (e.g., 16), for example.

In different embodiments, a pod (e.g., 61, 122, 123, or a combination thereof) is hollow, tubular, has a round cross section, or a combination thereof, as examples. In other embodiments, the pods (e.g., 61, 122, and 123) have a cross section other than round, for example, square, rectangular, hexagonal, pentagonal, octagonal, oval, triangular, or a sector, parallelogram, trapezoid (e.g., equilateral), trapezium, or rhombus as examples. In some embodiments, such shapes have rounded corners. In certain embodiments, pods (e.g., 61, 122, and 123) have a rounded surface that is shaped to provide a rounded external surface of the handguard (e.g., 16, which includes the pods 61, 122, and 123) when the pods are stowed (e.g., as shown in FIGS. 1-5). Further, in particular embodiments, sides (e.g., two or three sides) of the pod or pods opposite this rounded surface are flat, for example, with rounded corners. In particular embodiments, for instance, a pod has a cross section that is an obtuse sector with rounded corners or an isosceles triangle, trapezium, or trapezoid with rounded corners and one convex side.

In some embodiments, one or more sides of the pod or one or more of the pods (e.g., 61, 122, and 123) are furnished with holes therethrough or cutouts, for instance, round or oval cutouts, for example, to reduce weight. In certain embodiments, such cutouts are omitted from the side of the pod (e.g., the rounded surface described above) that faces outward from the handguard (e.g., 16) when the pod is stowed, for instance, to reduce or avoid debris entering the cutouts. In some embodiments, however, cutouts are provided on the outside of the pods or on opposite or multiple sides of the pods, for example, to provide ventilation to dissipate heat from the barrel (e.g., 13), to provide a higher friction surface for the operator to grip, or both.

In various embodiments, one, multiple, or all of the pods (e.g., 61, 122, and 123) are telescopically extendable, for example, to adjust the length of the pod for different firing situations, for instance, formed from two or more concentric tubes. In different embodiments, a mechanism, such as a latch (e.g., 66 shown in FIGS. 6, 9, 11, and 12), is provided, for instance, for each pod or for each pod that is extendable to hold the pod extended the desired distance. In FIG. 9, telescoping first pod 61 or monopod 81 is shown partially extended, for example. In some embodiments, the telescoping feature of the pod must be retraced completely or partially in order to (e.g., fully) stow the pod (e.g., within in the handguard).

In some embodiments, in addition to, or instead of, the pod being telescopically extendable, the pod includes an adjustable (e.g., threaded) foot (e.g., 99, 138, and 139), for instance, for each pod (e.g., 61, 122, and 123 shown) that provides for (e.g., fine) adjustment, in some embodiments, of the length (e.g., 90 shown in FIG. 9) of the pod (e.g., 61 for length 90). As used herein, an "adjustable threaded foot that provides length adjustment", that is part of a pod, provides for adjustment of the length of that pod (e.g., foot 99 and length 90 of first pod 61). In some embodiments, the pod (e.g., 61, 122, or 123) or foot (e.g., 99, 138, or 139) has an elastomeric or rubber end or tip (e.g., 60 shown in FIGS. 6, 8, and 11-13), for example. In a number of embodiments, this is the lower end or tip when the pod is deployed, the aft end when the pod is stowed, or both. In some embodiments, the adjustable foot (e.g., 99, 138, or 139) of the pod must be retraced completely or partially in order to (e.g., fully) stow the pod (e.g., within in handguard 16).

Still further, certain embodiments include a catch (e.g., 97, 107, or 108, shown for instance, in FIGS. 9 and 10), for example, for each pod (e.g., as shown). Further, in different embodiments, the pod or pods (e.g., 61, 122, and 123) can be stowed within a groove or hollow, for example, within the handguard (e.g., 16). In a number of embodiments, the catch (e.g., 97, 107, or 108) retains or secures the pod (e.g., 61, 122, or 123) when the pod is stowed (e.g., as shown in FIGS. 1-5), for example, within the groove, hollow, or handguard (e.g., 16). In a number of embodiments, the pod (e.g., 61, 122, or 123) drops down when the operator pushes or slides the catch (e.g., 97, 107, or 108 respectively), for instance, in the aft direction. In other embodiments, the operator must pull the pod down when the catch is released.

Figure 5:
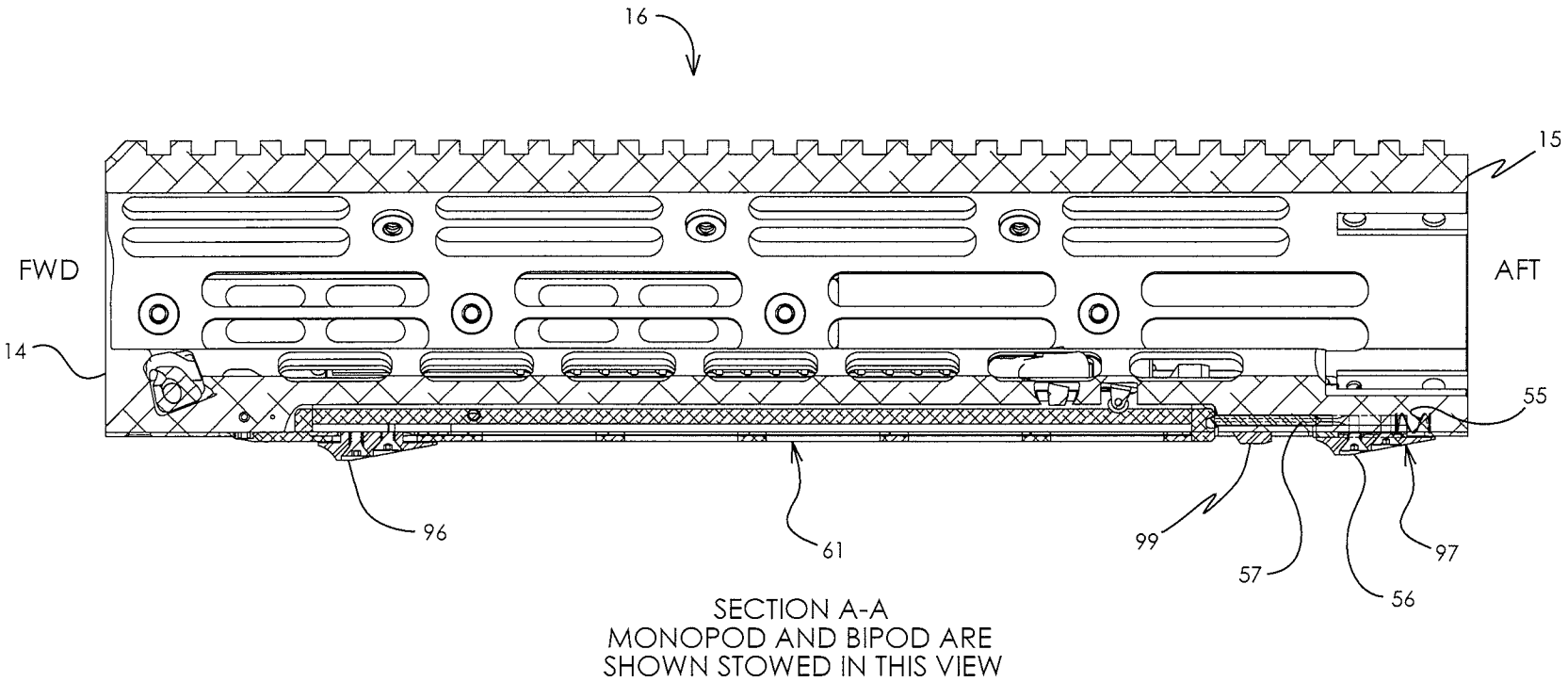
FIG. 5 is a left side cross-sectional view of part of the handguard of the firearm of FIG. 1 taken along section A-A in FIG. 4, shown with all pods in the stowed position.

In the embodiment illustrated, helical catch return spring 55, shown in FIGS. 5 and 10, returns the catch (97 for pod 61) to the latch position when catch 97 is released by the operator. Catches 107 and 108 may have a similar catch return spring. Also shown in FIG. 5, in a number of embodiments, the catch (e.g., 97) includes an internal slide catch (e.g., 57) and an external catch slide button (e.g., 56), for instance, attached to the slide catch (e.g., 57), for example, with one or more screws (e.g., two screws shown). In the embodiment illustrated, slide catch 57 engages pod 61, and the operator releases catch 97 by pushing catch slide button 56. Catches 107 and 108 are similar in a number of embodiments.

As described, in some embodiments, the firearm (e.g., 10) or handguard (e.g., 16) has a first pod (e.g., 61) deployable as a monopod (e.g., 81) and a second pod (e.g., 122) and a third pod (e.g., 123) deployable together as a bipod (e.g., 132). In particular embodiments, the first pod (e.g., 61) is pivotably attached to the handguard (e.g., 16) aft of where the second pod (e.g., 122) and the third pod (e.g., 123) are pivotably attached to the handguard (e.g., 16). In some embodiments, the second pod (e.g., 122) and the third pod (e.g., 123), for instance, that form the bipod (e.g., 132) are pivotably attached to the handguard (e.g., 16) at the same location or at substantially the same location in the forward and aft direction (e.g., parallel to barrel 13 of firearm 10). In this context, the "same location" means within $1/16^{th}$ of an inch, and "substantially the same location" means within $1/4^{th}$ of an inch. An example of relative attachment locations of the different pods is shown, for instance, in FIG. 3, and can also be seen by comparing FIG. 6 with FIG. 11.

As used herein, "aft" means the direction opposite the direction that the bullet is traveling in when the bullet leaves the firearm (e.g., 10). In contrast, as used herein, "forward" means the direction that the bullet is traveling in when the bullet leaves the firearm (e.g., 10). Further, forward end 14 and aft end 15 of handguard 16 are identified on FIGS. 1-3, 5-7, and 9-12. Still further, as used herein, a first component or assembly is considered to be aft of a second component or assembly if the center of mass of the first component or assembly is aft of the center of mass of the second component or assembly.

Even further, in some embodiments, the first pod (e.g., 61), the second pod (e.g., 122), and the third pod (e.g., 123) each have a common length (e.g., length 90 shown in FIG. 9 for pod 61). As used herein, a length of a pod is measured parallel to the pod. As used herein, where two components are described as having a common length, the length of those two components are the same to within ten percent of the length of the longer component. Further, as used herein, the length of a pod is determined when the pod is stowed or is adjusted to a length that can be fully stowed. Even further, if a pod can be stowed at different lengths, the length of the pod that is used herein to compare lengths of the pods is the maximum length at which the pod can be fully stowed.

Still further, in particular embodiments, the first pod is pivotably attached (e.g., with at least one hinge pin) to the handguard (e.g., the body of the handguard) aft of where the second pod and the third pod are pivotably attached to the handguard by a distance substantially equal to the common length of the pods. As used herein, "substantially equal", when referring to lengths, means equal to within 20 percent. Further, in some embodiments, the first pod is pivotably attached to the handguard aft of where the second pod and the third pod are pivotably attached to the handguard by a distance that is equal to the common length. As used herein, equal, unless stated otherwise, means to within ten percent.

In the embodiment shown, however, the first pod (e.g., 61) is pivotably attached (e.g., with hinge pins 101 and 102) to the handguard (e.g., 16) or the body of the handguard (e.g., 16) aft of where the second pod (e.g., 122) and the third pod (e.g., 123) are pivotably attached to the handguard (e.g., 16) by a distance that is substantially less than the common length of the pods or the length (e.g., 90) of the pod (e.g., 61). As used herein, "substantially less" means less than half. In some embodiments, the first pod (e.g., 61) is pivotably attached (e.g., with hinge pins 101 and 102) to the handguard (e.g., 16) or the body of the handguard (e.g., 16), for instance, aft of where the second pod (e.g., 122) and the third pod (e.g., 123) are pivotably attached to the handguard (e.g., 16) by a distance that is less than 25 percent of the common length (e.g., 90). In other embodiments, however, the first pod is pivotably attached to the handguard forward of where the second pod and the third pod are pivotably attached to the handguard, as another example. Moreover, in some embodiments, the handguard (e.g., 16) includes a forward end (e.g., 14) and an aft end (e.g., 15) and the first pod (e.g., 61), the second pod (e.g., 122), and the third pod (e.g., 123) are all pivotably attached to the handguard (e.g., 16) at the forward end (e.g., 14). As used herein, a pod is considered to be attached at a particular end of a handguard if the pod is attached to the particular end of the handguard within 25 percent of the length (e.g., 90) of the pod.

In some embodiments, the bipod (e.g., 132) and the monopod (e.g., 81) can be deployed separately depending on whether the operator of the firearm (e.g., 10) prefers to use a monopod (e.g., 81) or a bipod (e.g., 132) at the time. In particular embodiments, however the bipod (e.g., 132) and the monopod (e.g., 81) can be deployed at the same time. Further, in certain embodiments, the three pods can fully support the firearm. When so supported, in some embodiments, the angle of the firearm can be adjusted, for example, with the telescopic capability of the pods, the adjustable nature of the feet, or both, or via another mechanism. This can be done, for example, to sight at a particular target or in a particular area for an extended period of time, for instance, while minimizing fatigue of the operator.

In certain embodiments, one, some, or all of the pods (e.g., 61, 122, and 123) have more than one (e.g., pair of) detents (e.g., in the handguard), and the pod or pods can be locked (e.g., with the locking pins) at different angles, for example, for different firing situations. In some embodiments, for example, the bipod can angle or extend forward and the monopod can angle or extend aft, for instance, to form a tripod. In other embodiments, for another example, the bipod can angle aft and the monopod can angle forward. Other embodiments may lack this feature, however, or may accomplish this functionality through different structure. In the embodiment illustrated, monopod 81 is vertical and bipod 132 angles forward, for example.

In a number of embodiments, a firearm or handguard includes a sub-combination of the components or features described herein. Additionally, various embodiments may include other components not described here, for example, other components that are known in the art. Further, various embodiments include other combinations of the features described herein. All feasible combinations are contemplated. Moreover, in addition to firearms (e.g., 10) and handguards (e.g., 16), also contemplated, in a broader sense, are various apparatuses for supporting a firearm (e.g., 10). In various embodiments, the firearm (e.g., 10) includes a barrel (e.g., 13) having an axis. Such an apparatus can include, for example, multiple pods (e.g., 61, 122, and 123) deployable from the apparatus to support the firearm (e.g., 10), for instance, off of the ground or other surface. In various embodiments, the multiple pods (e.g., 61, 122, and 123) are attached to the apparatus at two different locations along the apparatus, the two different locations being separated in a direction parallel to the axis of the barrel, for instance, by a distance that is substantially less than a length (e.g., 90) of one of the pods (e.g., 61, 122, and 123), for instance, when the pod is stowed in the apparatus.

In some embodiments, the multiple pods (e.g., 61, 122, and 123) include a first pod (e.g., 61) deployable as a monopod (e.g., 81), a second pod (e.g., 122), and a third pod (e.g., 123), wherein the second pod (e.g., 122) and the third pod (e.g., 123) are deployable together as a bipod (e.g., 132). Further, in certain embodiments, the two different locations include a first location in the direction parallel to the axis of the barrel where the first pod (e.g., 61) is attached to the apparatus, and a second location in the direction parallel to the axis of the barrel where the second pod (e.g., 122) and the third pod (e.g., 123) are attached to the apparatus. Even further, in particular embodiments, the first location is aft of the second location. Further still, various apparatuses include, in addition or instead, various combinations of other components, features, and other limitations recited herein, as other examples.

Still other embodiments include certain methods that pertain to handguards (e.g., 16) or pod systems for firearms (e.g., 10), for example. Particular methods can include acts of obtaining or providing, as examples, various features, components, or aspects described herein. All possible combinations are contemplated. Further, methods described herein contain various acts. The order in which these acts are described herein is an example of the order in which these acts can be performed, but in other embodiments, unless stated otherwise herein or precluded by other factors, the acts may be performed in a different order. In some embodiments, acts may overlap or be performed at the same time, as another example.

Examples of methods include various methods of supporting a firearm (e.g., 10) having a barrel (e.g., 13) that has an axis. Such a method can include for instance, an act of obtaining, providing, or manufacturing a handguard (e.g., 16) for the firearm (e.g., 10), the handguard (e.g., 16) including multiple pods (e.g., 61, 122, and 123) deployable from the handguard (e.g., 16) to support the firearm (e.g., 10), for example, off of the ground or other surface. In a number of embodiments, the multiple pods (e.g., 61, 122, and 123) are attached to the handguard (e.g., 16) at two different locations along the handguard (e.g., 16), and the two different locations are separated in a direction parallel to the axis of the barrel (e.g., 13) by a distance that is substantially less than a length (e.g., 90) of one of the pods (e.g., 61, 122, and 123), for instance, when the pod is stowed in the handguard (e.g., as shown in FIGS. 1-5). Yet other embodiments include various methods of making a firearm (e.g., 10) easier to be used (e.g., at least by certain people). Various methods include, in addition or instead, various combinations of acts of obtaining or providing other components, features, and other limitations recited herein, as other examples. All different combinations are contemplated. Various methods can further include acts of manufacturing other components described herein, shown on the drawings, or both.

In a number of embodiments, the firearm (e.g., 10) is a rifle. In particular embodiments, for example, the firearm (e.g., 10) is an assault rifle, such as an AR-15 or an M-16. In some embodiments, the firearm can be a semi-automatic firearm or a fully automatic firearm, as examples. Further, in particular embodiments, the firearm is a rifle configured to selectably (e.g., via operation of a selector lever) fire in a fully-automatic mode and in a semi-automatic mode. Other embodiments, however, may differ. For instance, in particular embodiments the firearm can be a pistol.

If there are any conflicts or inconsistencies between this patent application and the patent application incorporated by reference, this patent application governs herein. Further, various embodiments of the subject matter described herein include various combinations of the acts, structure, components, and features described herein, shown in the drawings, described in documents that are incorporated by reference herein, or that are known in the art. Moreover, certain procedures can include acts such as manufacturing, obtaining, or providing components that perform functions described herein or in the documents that are incorporated by reference.

The subject matter described herein also includes various means for accomplishing the various functions or acts described herein, in the documents that are incorporated by reference, or that are apparent from the structure and acts described. Each function described herein is also contemplated as a means for accomplishing that function, or where appropriate, as a step for accomplishing that function. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A firearm comprising:

a frame defining a medial plane;

a barrel extending from the frame in a forward direction;

a handguard connected to the frame and extending in the forward direction;

the handguard having a forward end extending away from the frame;

a first elongated leg having a forward end pivotally connected to the handguard at a first pivot location and an opposed end extending away from the pivot location;

the first elongated leg occupying the medial plane;

second and third elongated legs each pivotally connected to the frame at respective spaced apart second and third locations with the first leg therebetween; and each of the first, second and third legs being independently movable between a deployed position in which a free end is away from the handguard and a stowed position in which the leg is adjacent the handguard, such that the first leg alone serves as a monopod and the second and third legs serve as a bipod.

2. The firearm of claim 1 wherein the first leg pivots about a horizontal axis and the second and third legs pivot about axes offset from the horizontal axis to generate splayed second and third legs when in the extended position.

3. The firearm of claim 1 wherein the handguard defines an elongated aperture sized to closely receive each leg when in the stowed position.

4. The firearm of claim 1 wherein each leg has a lower surface flush with the handguard when the leg is in the stowed position.

5. The firearm of claim 1 wherein the handguard has a polygonal lower portion having a horizontal elongated center panel, and opposed elongated adjacent panels angled upward from the center panel.

6. The firearm of claim 5 wherein each leg pivots about a pivot axis parallel to an associated handguard panel.

7. The firearm of claim 6 wherein each handguard panel defines an aperture receiving an associated leg.

8. The firearm of claim 1 wherein the pivot axes of the second and third legs are located at the same selected distance from the frame.

9. The firearm of claim 8 wherein the pivot axis of the first leg is located at a distance from the frame different from the selected distance.

10. The firearm of claim 9 wherein the pivot axis of the first leg is located at a lesser distance from the frame than the selected distance.

* * * * *